United States Patent [19]

Wilhelm

[11] 4,319,072

[45] Mar. 9, 1982

[54] CABLE CONSISTING OF THREE BUNDLES EACH HAVING THREE STRANDS

[75] Inventor: Wilhelm Wilhelm, Munich, Fed. Rep. of Germany

[73] Assignee: Siemens Aktiengesellschaft, Berlin & Munich, Fed. Rep. of Germany

[21] Appl. No.: 177,623

[22] Filed: Aug. 13, 1980

[30] Foreign Application Priority Data

Sep. 27, 1979 [DE] Fed. Rep. of Germany ..... 2939171

[51] Int. Cl.[3] ..... H01B 11/04

[52] U.S. Cl. ..... 174/34; 174/113 R

[58] Field of Search ..... 174/34, 113 R

[56] References Cited

U.S. PATENT DOCUMENTS

| | | | |
|---|---|---|---|
| 297,177 | 4/1884 | Shelbourne | 174/34 |
| 469,522 | 2/1892 | Hayes | 174/34 |
| 2,953,627 | 9/1960 | Malneritch | 174/113 R X |
| 3,099,703 | 7/1963 | Martin | 174/34 |
| 3,978,275 | 8/1976 | Ishihara | 174/34 |
| 4,227,041 | 10/1980 | Shimizu | 174/113 R X |

FOREIGN PATENT DOCUMENTS

| | | | |
|---|---|---|---|
| 54-142585 | 11/1979 | Japan | 174/34 |
| 453198 | 9/1936 | United Kingdom | 174/34 |

*Primary Examiner*—Richard R. Kucia

*Attorney, Agent, or Firm*—Hill, Van Santen, Steadman, Chiara & Simpson

[57] ABSTRACT

In a cable consisting of three bundles each having three strands each bundle is rotated by 60° in each of two consecutive longitudinal sections, no rotation occurring in the third section. The sections without rotation are displaced by one section for each bundle. Therefore, a close coupling of the strand of a bundle to all strands of the other bundles and a phantom surge impedance which only slightly differs from the surge impedance of the bundle are achieved. In addition, the bundles are twisted. The cable is suited for the simultaneous push-pull transmission of a maximal ten independent, binary signals in both directions.

3 Claims, 5 Drawing Figures

CABLE CONSISTING OF THREE BUNDLES EACH HAVING THREE STRANDS

BACKGROUND OF THE INVENTION

1. Field of the Invention

The present invention relates to cables, and more particularly to cables having a plurality of conductors which are disposed in groups of three bundles each having three strands.

2. Description of the Prior Art

The push-pull transmission of digital signals by way of pairs of conductors is advantageous in that different ground potentials do not interfere with each other at the transmitting and receiving stations. However, the great demand for conductors is disadvantageous in the parallel transmission of a plurality of bits. As is known, an improvement of the ratio of items of information which can be simultaneously transmitted, to the total number of physical conductors from 0.5 bit to 0.75 bit results from the formation of so-called phantom circuits each of which consists of two double conductors. Furthermore, while maintaining the push-pull principle, it is possible to increase the number of the potential stages on the conductors of the conductor bundles having three and more conductors, to above two and thus to further improve the ratio of the items of information which can be transmitted to the number of conductors (cf German patent application No. P 29 39 252.7).

In a three-conductor bundle, the transmission capacity, for example, increases theoretically to the value 2.5. All three conductors have the same surge impedance relative to one another. On the other hand, in a four-conductor bundle, the surge impedances of adjacent and diagonal conductors usually differ from one another.

The further increase in the transmission capacity is achieved by combining three three-conductor bundles in one cable. Therefore, a fourth three-conductor arrangement which is to be referred to as a three-conductor phantom arrangement is obtained. In this manner, up to 10 bits ($4\times2.5$ bit) can be transmitted via nine conductors.

SUMMARY OF THE INVENTION

The object of the present invention is to arrange the strands in a cable consisting of three bundles, each of which has three strands, in such a manner that a close, in particular equal coupling of the strands of a bundle to all strands of the other bundles is provided, even after relatively short cable lengths ($\approx$0.1 m), and that the surge impedance which prevails between the bundles is at least approximately identical to the surge impedance which prevails between the strands of the bundle.

According to the present invention, the above object is achieved in that all strands are arranged within a trapezoid in each case after identical periodically recurring longitudinal sections, and that the following bundles are rotated by 60° in the same direction of rotation, the second and third bundle within a first longitudinal section, the first and second bundle within the following longitudinal section, and the third and first bundle within the third longitudinal section, and so on, is thus provided.

BRIEF DESCRIPTION OF THE DRAWINGS

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1A:
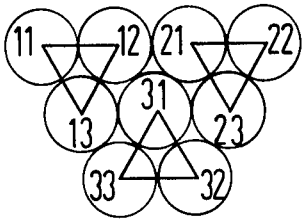
FIGS. 1*a*–1*d* illustrate capable cross-sections at locations which follow one another at equal intervals in the longitudinal direction of the cable.

In the illustration of the cable cross-sections in accordance with FIGS. 1*a*–1*d* it is assumed that the circles represent the individual strands inclusive of their insulation. It should be noted that the strands 11 to 13, 21 to 23 and 31 to 33 of the individual bundles are adjacent to one another at each location on the cable in such a manner that the rectilinear connections of their center points form an equilateral triangle as indicated in FIG. 1*a*. All cross-sections which are illustrated in FIGS. 1*a*–1*d* are equidistantly spaced apart.

Figure 1B:
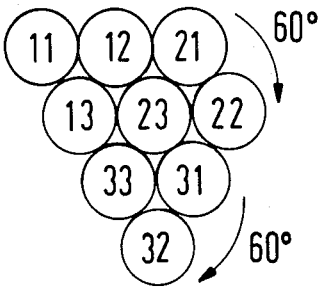

The comparison of the cross-sections in accordance with FIG. 1*a* and FIG. 1*b* shows that the second bundle and third bundle having the strands 21 to 23 and 31 to 33 have been rotated clockwise by 60° which can be readily recognized from the reference characters. Furthermore, the rotation is indicated by arrows beside the bundles concerned. The trapezoids which are formed by the strands 11 to 33 in the cross-sections illustrated in FIGS. 1*a* and 1*b* seem to be rotated counterclockwise by 120°. The spacings of the two cross-sections in accordance with FIGS. 1*a* and 1*b* in the longitudinal direction of the cable is dependent upon the twist of the second and third bundles and amounts, for example, for a strand diameter of 0.7 mm, to approximately 1 cm.

Figure 1C:
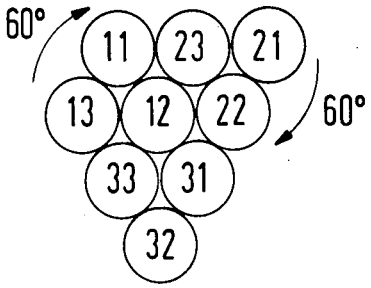
Figure 1D:
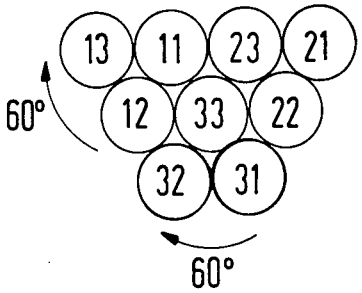

It can be gathered from the illustration of the cross-section in accordancae with FIG. 1*c* that contrary to the proceeding cross-section, the first bundle and again the second bundle are rotated by 60°. Finally a rotation of the first and third bundles by 60° can be recognized in the illustration of FIG. 1*d*. The comparison of the coss-sections in accordance with FIGS. 1*a* and 1*d* illustrates that all bundles have now been rotated by 120°. Everything is repeated in the further course of the cable.

Hence, it follows that periodically recurring locations with equal mutual spacing exist in the longitudinal direction of the cable, at which locations the strands fill out a symmetrical trapezoid. These spacings are to be referred to as elementary spacings. Therefore, the following rule can be layed down: p1 (a) each bundle of strands is rotated by 60° in each of two consecutive elementary spacings and no rotation occurs in the third elementary spacing; and (b) the elementary spacing without rotation are displaced by one elementary spacing for each bundle.

The previous description of the construction of the cable allows the conclusion that the center point of the bundles of strands are virtually located on straight lines. As is known, this would, however, substantially impair the flexibility of the cable and also render difficult the production thereof. Therefore, the cable is twisted overall; however, this does not affect the mutual allocation of the strands and has therefore not been expressed on the drawing for the sake of clarity. For the final completion of manageable product, the bundle of strands is taped in a manner which is known per se with an insulating foil and is covered with an insulating sheath.

Figure 2:
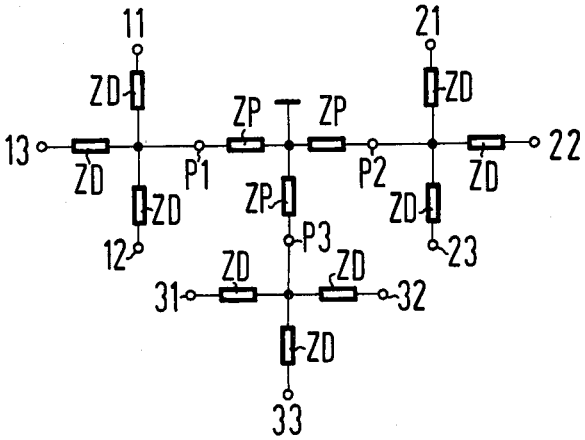
FIG. 2 illustrates the terminal network of the cable.

A terminal network for the cable whose construction has been described above is illustrated in FIG. 2. Between the ends of the strands 11 to 13, 21 to 23 and 31 to 33 of the individual bundles and the corresponding center points of the bundles P1 to P3 are arranged identical resistances ZD. The points P1 to P3 are connected with the phantom center point by means of identical resistances ZP. One then has 3 ZD = surge impedance of the three-conductor bundle, and 3 ZP = surge impedance of the three-conductor phantom arrangement.

For an exemplary embodiment, in practice the surge impedance of the three-conductive bundle is 110 Ohm and the surge impedance of the three-conductor phantom arrangement is 90 Ohm.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A cable consisting of: three bundles each including three strands, all of said strands arranged within a trapezoid, in each case after identical periodically recurring longitudinal sections the first, second and third bundles are displaced by 60° in the same direction of rotation with said second and third bundles so displaced within a first longitudinal section, said first and second bundles so displaced within the following longitudinal section, and said third and first bundles so displaced within a third longitudinal section.

2. A cable as claimed in claim 2, wherein said bundles are in a twisted relation with one another.

3. A cable as claimed in claim 2, wherein said strands are covered by an insulating sheath.

* * * * *